137-13 SR
12/18/79 OR 4,178,950

United States Patent [19]

Sweeney

[11] 4,178,950

[45] Dec. 18, 1979

[54] RESIDUAL FUEL COMPOSITIONS WITH LOW POUR POINTS

[75] Inventor: William M. Sweeney, Wappingers Falls, N.Y.

[73] Assignee: Texaco Inc., White Plains, N.Y.

[21] Appl. No.: 949,915

[22] Filed: Oct. 10, 1978

[51] Int. Cl.[2] ..... F17D 1/17

[52] U.S. Cl. ..... 137/13; 44/62; 44/70

[58] Field of Search ..... 44/62, 70; 137/13; 260/878; 526/331

[56] References Cited

U.S. PATENT DOCUMENTS

| | | | |
|---|---|---|---|
| 3,048,479 | 8/1962 | Ilnyckyj et al. | 44/62 |
| 3,462,249 | 8/1969 | Tunkel | 44/62 |
| 3,467,597 | 9/1969 | Tunkel et al. | 44/62 |
| 3,675,671 | 7/1972 | Sweeney et al. | 137/13 |
| 3,870,063 | 3/1975 | Hayward | 137/13 |
| 4,127,140 | 11/1978 | Sweeney | 137/13 |

*Primary Examiner*—Winston A. Douglas
*Assistant Examiner*—Y. Harris-Smith
*Attorney, Agent, or Firm*—Carl G. Ries; Robert A. Kulason; Walter D. Hunter

[57] ABSTRACT

A low pour point residual fuel oil composition is prepared from a major amount of a high pour point, low sulfur, waxy, residual fuel and a minor amount of a low wax, low pour, residual fuel oil by adding thereto from 0.01 to 0.5% by weight of an oil soluble terpolymer such as vinyl acetate-ethylene-propylene or butylene or a graft copolymer in which propylene or butylene is grafted onto an ethylene-vinyl acetate copolymer backbone or basic chain, having preferably, a number average molecular weight of about 12,000 to about 60,000. In another aspect, this invention relates to a process for the pipeline transportation of the low pour residual fuel oil compositions previously described.

9 Claims, No Drawings

RESIDUAL FUEL COMPOSITIONS WITH LOW POUR POINTS

BACKGROUND OF THE INVENTION

1. Field of the Invention

This invention is concerned with means for providing a low sulfur, low pour fuel oil composition. More particularly, the invention is concerned with a fuel oil composition containing a major amount of a high pour, low sulfur, waxy residual fuel and a minor amount of a low wax, low pour, residual fuel oil, this blend having a reduced pour point relative to its components owing to the incorporation therein of a minor amount of an oil-soluble terpolymer or graft copolymer.

2. Description of the Prior Art

As is well known, residual fuel oils contain quantities of wax and asphaltic compounds which render them viscous and which sometimes interfere with practical use thereof. Particularly serious problems can be encountered in pumping residual fuel oils to a burner and in making them flow at low temperatures. Other factors to be reckoned with in regard to these oils are the facts that they behave as non-Newtonian liquids at low temperatures; exhibit variable solidifying temperatures and manifest peculiar hysteresis phenomena—all of which result in difficulties in equipment design.

One approach used in making these oils easier to handle has been to subject them to fairly lengthy and costly dewaxing procedures.

Another approach which has been suggested and tried in order to bring the viscosity of residual fuel oils to suitable levels has been to dilute or "cut" them with a major amount of lighter distillate oils. This procedure is expensive because of the considerably higher cost of the distillate oils relative to that of residual oils.

In recent years it has been recommended to incorporate additives in lubricating oils and in so-called middle distillates in order to tie in the wax present therein and to improve flow characteristics at reduced temperatures. The additives in question consist either of compounds formed by alkylating benzene or naphthalene derivatives; or, of copolymers of ethylene-vinyl fatty acid ester of a molecular weight up to 3,000 containing from 15 to 25 percent by weight of the vinyl fatty acid ester.

The main object of the present invention, accordingly, is to provide for critical blending of high pour waxy residual fuel oils with low waxy, low pour residual fuel oils to give large increases in pour reduction without employing elaborate dewaxing procedures.

An equally important object of the claimed invention is to provide a novel fuel oil blend characterized by a low sulfur content and a reduced pour point resulting from the incorporation therein of a small amount, for example, a terpolymer of vinyl acetate, ethylene and propylene or butylene.

A further object of the claimed invention is to provide a fuel oil blend which will be stable at different blend temperatures over prolonged storage times.

BRIEF DESCRIPTION OF THE INVENTION

In its broadest aspect this invention relates to fuel oil compositions having low pour points comprising a major amount of a high pour, low sulfur, waxy residual fuel, and a minor amount of a low wax, low pour residual fuel containing an effective pour depressant amount of an oil-soluble terpolymer or a graft copolymer. The terpolymer used in preparing the crude oil compositions of this invention is a vinyl acetate-ethylene, propylene or butylene terpolymer while the graft copolymer comprises an ethylene-vinyl acetate backbone or basic chain having grafted thereto propylene or butylene. In another aspect this invention relates to a process for the pipeline transportation of the above-described fuel oil compositions.

DETAILED DESCRIPTION OF THE INVENTION

The residual fuel oil composition of this invention comprises a major amount (i.e., over 50 percent by volume) of a high pour, low sulfur waxy, residual fuel oil having an API gravity of about 20.0 to about 25.0; a sulfur content of between about 0.40 wt. % and about 0.96 wt. %; a Furol viscosity at 122° F. of about 60 to about 230; a flash point of between about 300° and 450° F., with a wax content of between about 10 and 20 percent; and a minor amount (i.e. less than 50 percent by volume) of a low waxy, low pour residual fuel oil having an API gravity of about 10.0 to about 15.0; a Furol viscosity at 122° F. of about 150 to about 250; a flash point of about 220° to about 350° F.; a pour point of between about 25° F. and about 45° F., a wax content of between about 2 and 5 weight percent with a sulfur content of between about 0.50 and about 0.90 weight percent. A waxy, low pour residual fuel oil which has given particularly good results as the minor constituent of the claimed blend is that known as No. 6 Fuel Oil (Is this Louisiana No. 6?) which has an API gravity of about 12.3, a Furol viscosity of 207.0 at 122° F., a pour point of about 40° F. and a wax content of about 3 percent.

Preferably, the residual fuel oil compositions of this invention will contain about 55 to about 85 volume percent of the high pour, low sulfur, waxy residual fuel; about 45 to 15 volume percent of the low wax, low pour residual fuel and about 0.01 to about 0.5 weight percent of the oil soluble terpolymer or graft type copolymer.

One type of oil-soluble terpolymers useful in preparing the crude oil compositions of this invention comprises recurring units of vinyl acetate, ethylene and propylene or butylene.

The number average molecular weight of the vinyl acetate-ethylene-propylene or butylene terpolymer utilized in this invention as previously described will range from about 5000 to about 80,000 or more and preferably will be from about 12,000 to about 60,000 as determined by vapor pressure osmometry.

In the vinyl acetate-ethylene-propylene or butylene terpolymer the weight percent of the vinyl acetate units is about 10 to about 45; the weight percent propylene or butylene units is about 0.01 to about 5.0 with the ethylene units being the balance.

Preparation of the vinyl acetate-ethylene-propylene or butylene terpolymer is conducted using processes well known in the art. For example, ethylene, vinyl acetate, and propylene in benzene are reacted in a stirred autoclave at a temperature of about 130° to about 150° C. and under pressures ranging from about 700 to 2000 psig. A variety of catalysts may be utilized however, a preferred catalyst is di-tert.butyl peroxide which is added in benzene at the rate of about 0.5 to 2.0 lbs./1000 lbs. of polymer. Residence time in the reactor is about 0.1 to about 1.0 hours or more. After the reaction mixture is removed from the reactor, the solvent and unreacted starting materials are stripped off yielding the terpolymer product.

In the graft copolymers utilized in this invention, propylene or butylene is grafted onto a backbone or basic chain which is a copolymer of ethylene and vinyl acetate. The weight percent of propylene or butylene ranges from about 0.6 to about 5.0 and the weight percent of vinyl acetate is about 17 to about 40 with the balance being ethylene. The number average molecular weights of these graft copolymers will range from about 4000 to about 80,000 or more.

The ethylene-vinyl acetate copolymers utilized in preparing the graft copolymers may be prepared by any convenient process, such as that of U.S. Pat. Nos. 3,048,479 and 3,215,678, by a free radical-initiated polymerization of ethylene and a vinyl acetate. An especially useful group of ethylene-vinyl acetate copolymers are those manufactured by E. I. duPont de Nemours and sold under the tradename "Elvax". The characteristics of the various Elvax additives are given in Table I below:

TABLE I

| "Elvax" | % Vinyl Acetate in Copolymer | Melt Index* |
|---|---|---|
| 40 | 39-42 | 45-70 |
| 150 | 32-34 | 22-28 |
| 210 | 27-29 | 335-465 |
| 220 | 27-29 | 125-175 |
| 240 | 27-29 | 22-28 |
| 250 | 27-29 | 12-18 |
| 260 | 27-29 | 5-7 |
| 310 | 24-26 | 335-465 |
| 350 | 24-26 | 16-22 |
| 360 | 24-26 | 1.6-2.4 |
| 410 | 17-19 | 430-580 |
| 460 | 17-19 | 2.1-2.9 |

*in g/10 min. as determined by ASTM 1328 modified.

In preparing the ethylene-vinyl acetate copolymers generally the polymerization is conducted at temperatures of about 280° to about 340° F. and at pressures ranging from about 700 to about 2000 psig and, preferably, at about 750 to about 950 psig. The autoclave employed containing the solvent such as benzene, toluene, etc. and the vinyl acetate is first purged about three times with nitrogen, twice with ethylene and then charged with sufficient ethylene to give the desired pressure when heated to the reaction temperature. Additional ethylene is added as the polymerization proceeds whenever it is needed. Generally the polymerization is considered to be complete when the pressure of the autoclave drops to less than about 60 psig. The viscous copolymer is recovered by stripping off the solvent and any unreacted vinyl acetate which remains under vacuum.

Graft copolymers where the graft is propylene or butylene and the basic chain is a copolymer of ethylene and vinyl acetate, can be made, for example, by redissolving an ethylene-vinyl acetate copolymer in benzene or other suitable hydrocarbon solvent, placing the copolymer solution in a stirred autoclave with the requisite amount of propylene or butylene together with a peroxide type catalyst and continuing the polymerization under the influence of heat and pressure. Temperatures of from about 250° to about 400° F. may be employed at autogenous pressure.

The amount of terpolymer or graft copolymer pour depressant incorporated into the residual fuel oil compositions of this invention may be varied over a wide range. Generally the amount of the terpolymer in the residual fuel oil composition will vary from about 0.01 to about 0.50 weight percent and preferably between about 0.02 to about 0.25 weight percent.

The required amount of vinyl acetate-ethylene-propylene or butylene terpolymer or the graft copolymer may be added with mixing directly to the residual fuel which is preferably heated. Preferably, the terpolymer or graft type copolymer is added to the residual fuel in solution form dissolved in a hydrocarbon such as toluene, kerosene, etc., at a temperature of about 30° to about 150° C. with mixing.

The following examples which illustrate this invention are to be considered not limitative.

EXAMPLE I

A terpolymer is prepared by introducing 10 parts of ethylene, 4.3 parts vinyl acetate, 0.1 part of propylene and 3 parts of benzene per hour into a stirred 2-liter autoclave maintained at a temperature of 140°-150° C. at 1450 psig.Di-tert. butyl peroxide is employed as the catalyst and is introduced in benzene into the reactor at the rate of 0.8 lbs./1000 lb. of polymer. The product is continuously removed from the reactor giving a residence time of 15 minutes. After the reaction mixture is removed from the reactor, it is stripped of solvent and unreacted materials yielding the terpolymer product. The composition of the terpolymer is about 26 weight percent vinyl acetate, 0.6 weight percent of propylene with the balance being ethylene. The number average molecular weight of the terpolymer as measured by vapor pressure osmometry is about 21,500.

A residual fuel oil composition is prepared by mixing at 185° F. for one hour 65 volume percent of F/18 residual fuel, about 35 volume percent of Louisiana No. 6 fuel oil and a sufficient amount of the above prepared terpolymer so that the concentration of the terpolymer is 0.15 weight percent. The pour point of this composition is determined by the method of ASTM D-97 and found to be substantially below that of the same fuel oil mixture without terpolymer which exhibits a pour point of 80° F. The pour point of the F/18 residual fuel alone is 95° F. while the pour point of the Louisiana No. 6 residual fuel is 30° F.

EXAMPLE II

A graft polymer is made by dissolving one part of di-tert. butyl peroxide and ten parts of Elvax 410 in 90 parts of benzene in a stirred 2-liter autoclave. The reactor is flushed three times with nitrogen and then twice with the olefin to be used as the grafting agent, i.e., propylene. The reactor is heated to 300° F. for four hours during which time the grafting reaction occurs. The product is removed from the reactor and stripped of solvent and unreacted materials. In the resulting polymer (Polymer I) about 2 parts of propylene is grafted onto 100 parts of Elvax 410.

A residual fuel oil composition is prepared by mixing at 200° F. for 1.5 hours 75 volume percent F/18 residual fuel and 25 volume percent of Louisiana No. 6 fuel oil and a sufficient amount of grafted Polymer I made above so that the concentration of the grafted polymer is 0.18 weight percent. The pour point of this composition is determined by ASTM D-97 and found to be substantially below that of the same fuel oil mixture without the grafted copolymer which exhibits a pour point of 80° F. or with a similar concentration of Elvax 410 which exhibits a pour point slightly below 80° F.

In another aspect, this invention relates to an improved process for the transportation of the novel fuel oil compositions described in detail above.

The improved process of this invention for the pipeline transportation of the residual fuel oil composition described above comprises introducing into the said pipeline a residual fuel oil composition comprising a major amount of a high pour point, low sulfur waxy, residual fuel oil and a minor amount of a low wax, low pour residual fuel oil and an effective pour depressant amount of one of the useful terpolymers of this invention, such as the vinyl acetate-ethylene-propylene or butylene terpolymer or the graft copolymer previously described. Generally, the amount of the terpolymer or graft copolymer will range from about 0.01 to about 0.50 weight percent.

What is claimed is:

1. A low pour residual fuel oil composition comprising a major amount of a high pour point, low sulfur, waxy, residual fuel and a minor amount of a low wax, low pour residual fuel oil and an effective pour depressant amount of an oil-soluble polymer selected from the group consisting of a terpolymer comprising recurring units of vinyl acetate, ethylene and an olefin selected from the group consisting of propylene and butylene and a graft copolymer comprising an ethylene-vinyl acetate copolymer backbone having grafted thereto an olefin selected from the group consisting of propylene and butylene.

2. The composition of claim 1 wherein the said oil-soluble polymer is a graft copolymer wherein the number average molecular weight of the said copolymer is from about 4000 to about 60,000; wherein the weight percent of vinyl acetate in the said graft copolymer is about 17 to about 40, and the weight percent of propylene or butylene is about 0.6 to about 5.0 with the balance being ethylene.

3. The composition of claim 1 wherein the said oil-soluble polymer is a terpolymer which comprises about 15 to about 28 weight percent vinyl acetate, from about 0.1 to about 5.0 weight percent propylene or butylene with the balance being ethylene.

4. The composition of claim 1 wherein the said oil-soluble polymer is a terpolymer which comprises about 26 percent by weight of propylene with the balance being ethylene.

5. The composition of claim 3 wherein the number average molecular weight of the said terpolymer will range from about 5000 to about 80,000.

6. The composition of claim 3 wherein the number average molecular weight of the said terpolymer will range from about 12,000 to about 60,000.

7. In the transportation of residual fuel oils, the improvement which comprises introducing into a pipeline a low pour residual fuel composition comprising a major amount of a high pour point, low sulfur waxy residual fuel and a minor amount of a low wax, low pour residual fuel and an effective pour depressant amount of an oil-soluble polymer selected from the group consisting of a terpolymer comprising recurring units of vinyl acetate, ethylene and an olefin selected from the group consisting of propylene and butylene and a graft copolymer comprising an ethylene-vinyl acetate copolymer backbone having grafted thereto an olefin selected from the group consisting of propylene and butylene.

8. The process of claim 7 wherein the said oil-soluble polymer is a terpolymer which comprises about 15 to about 28 weight percent vinyl acetate, from about 0.1 to about 5.0 weight percent propylene or butylene with the balance being ethylene.

9. The process of claim 7 wherein the said oil-soluble polymer is a terpolymer which comprises about 26 percent by weight vinyl acetate, about 0.6 percent by weight of propylene with the balance being ethylene.

* * * * *